US007373872B2

(12) United States Patent
Käch et al.

(10) Patent No.: US 7,373,872 B2
(45) Date of Patent: May 20, 2008

(54) DIAPHRAGM PUMP

(75) Inventors: Robert Käch, Sursee (CH); Christian Kissling, Fulenbach (CH)

(73) Assignee: KNF Flodos AG, Sursee (CH)

( * ) Notice: Subject to any disclaimer, the term of this patent is extended or adjusted under 35 U.S.C. 154(b) by 556 days.

(21) Appl. No.: 11/033,425

(22) Filed: Jan. 11, 2005

(65) Prior Publication Data

US 2005/0158190 A1 Jul. 21, 2005

(30) Foreign Application Priority Data

Jan. 15, 2004 (DE) ..... 10 2004 002 079

(51) Int. Cl.
*F01B 19/00* (2006.01)

(52) U.S. Cl. ..... 92/101; 92/93; 92/98 R

(58) Field of Classification Search ..... 92/93, 92/94, 96, 98 R, 101
See application file for complete search history.

(56) References Cited

U.S. PATENT DOCUMENTS 2,731,534 A * 1/1956 Hansen et al. ..... 92/93
3,008,427 A 11/1961 Foster et al.
3,223,045 A 12/1965 Shope
3,241,494 A 3/1966 Johnson
3,252,424 A * 5/1966 Johnson et al. ..... 92/93
3,291,064 A 12/1966 Foster
5,291,822 A * 3/1994 Alsobrooks et al. ..... 92/93
6,907,816 B2 * 6/2005 Bubb et al. ..... 92/98 R

FOREIGN PATENT DOCUMENTS

DE 198 19 408 11/1999
GB 734294 7/1955

* cited by examiner

*Primary Examiner*—Michael Leslie
(74) *Attorney, Agent, or Firm*—Volpe and Koenig, P.C.

(57) ABSTRACT

A diaphragm pump (1) is provided with an annular working chamber (6) and an annular diaphragm (3), which is fixed on its outer peripheral region (12) and on its inner edge region (13). The inner and the outer diaphragm fixing points are stationary relative to each other, and a drive element (8) connected to a pump drive for deflection of the annular diaphragm (3) contacts between the outer and inner fixing points. The drive element (8) is formed facing the diaphragm with a sleeve or ring shape with a diameter corresponding approximately to the annular working chamber (6) and contacts with one of its annular ends perpendicular to the diaphragm plane on the side of the annular diaphragm (3) facing the pump drive for deflection and for transmission of a back-and-forth movement to the annular diaphragm (3). A quick-running diaphragm fluid pump is created, for which a combination of high stroke count for simultaneously low pump capacities is provided and which nevertheless is structurally simple and stable in design.

17 Claims, 3 Drawing Sheets

DIAPHRAGM PUMP

BACKGROUND

The invention relates to a diaphragm pump with an annular working chamber and an annular diaphragm, which is fixed at its outer peripheral region and at its inner edge region. The inner and the outer diaphragm fixing points are stationary relative to each other, and a drive element connected to a pump drive for deflection of the annular diaphragm is attached between the outer and inner fixing points.

Dosing at small and very small pump capacities with the help of quick-running diaphragm pumps presents the problem that with increasing structural miniaturization, the production, especially of the diaphragm and its attached, preferably molded-on steel parts, is very difficult and/or non-economical. The high rpms of such diaphragm pumps are necessary so that the valves can work exactly and the tolerances for the manufacture of valve parts do not have to be set too tightly. Here, the diameter of the generally circular diaphragm, that is, the change in volume of the working chamber due to the deflection of the diaphragm, determines the pump capacity of the diaphragm pump, with the diaphragm being moved with the help of a steel connecting rod preferably molded-on in the center of the diaphragm. If the diameter of the diaphragm is very small, for example, approximately 5 mm or even smaller, then the steel connecting rod, which under some circumstances has a diameter of less than 1 mm, can be molded-on only with great difficulty. In addition, for such a miniaturization, it is also difficult to manufacture the hydraulic or pneumatic connections to the inlet and outlet valves of the working chamber. Despite the very small dimensions of the diaphragm with a diameter of, for example, 5 mm, a pump capacity of approximately 25 ml per minute would be achieved already for a working rpm of 3000 rotations per minute and a stroke of 0.8 mm. However, in many applications it would be desirable, to realize these or also smaller pump capacities with acceptable yet easily handled pump sizes.

SUMMARY

Therefore, there is the objective of creating a diaphragm pump, with which small and very small pump capacities can be pumped, with the structural size of the pump and especially its diaphragm enabling a simple and economical manufacture and adjustment of the components.

To achieve this objective, according to the invention, in particular, a diaphragm pump is provided with an annular working chamber and an annular diaphragm, and the drive element of the annular diaphragm facing the diaphragm is in the shape of a sleeve or ring with a diameter corresponding approximately to the annular working chamber and with one of its annular ends perpendicular to the diaphragm plane contacting the side of the annular diaphragm facing the pump drive for deflection and for transmission of a back-and-forth motion to the annular diaphragm.

On one hand, through the annular geometry of the annular diaphragm, the feed volume can be held small for an acceptable diameter of the annular diaphragm per feed stroke, and on the other hand, the sleeve-shaped drive element of the annular diaphragm forms a stable force-transmission element, which also enables a secure connection to the annular diaphragm and also to the pump drive.

For the same diameter, the annular surface of the diaphragm is smaller than a circular surface, so that the diameter of the annular diaphragm can still have an easily handled size even for micro-pumps with minimal pump capacities.

Such an annular diaphragm pump with greater diameter of the annular diaphragm and the similarly annular working chamber can therefore be manufactured and adjusted more simply, because the manufacturing problems due to the otherwise necessary, extreme miniaturization of the components do not exist. Above all, the connection of the sleeve-shaped drive element with the annular diaphragm can be realized with the greater diameter of this element, in particular, with reproducibility, good accuracy, and significantly less complexity than for known diaphragm pumps of comparable pump output, wherein the pump output can equal, in particular, less than 100 ml per minute, for example, less than 50 ml per minute.

From U.S. Pat. No. 3,291,064, a diaphragm pump, which is used as a fuel pump, is already known with an annular working chamber and also an annular diaphragm. For this pump, the drive for the suction stroke of the diaphragm is transferred from the working chamber side of the diaphragm by means of a ram through a central guide to the rear side of the diaphragm and there by a pressure plate to the diaphragm. For the working stroke of the diaphragm, there is a compression spring acting on the pressure plate. The connection between the pressure plate and the diaphragm is realized by means of rivet-like projections of a clamping ring, which is arranged on the working chamber side of the diaphragm and which extends through the diaphragm and the pressure plate with its rivet-like projections.

Such a construction is unsuitable especially for micro-pumps, because for the drive-transmission elements, there is only a very small amount of space and therefore only filigree dimensions would be possible, with corresponding disadvantages in terms of load capacity and service life. Another disadvantage is that the openings in the diaphragm for the attachment elements passing through the diaphragm form weak points in terms of a long-term seal. In addition, for feeding aggressive media, it must be taken into account that all of the parts located in the working chamber, thus the diaphragm or diaphragm surface, clamping ring and its attachment means, and the like must withstand these aggressive media. Due to the clamping ring projecting into the working chamber, the flow of the feed medium can be disrupted. Finally, this pump disadvantageously has a comparatively large dead volume.

For the diaphragm pump according to the invention, the drive transmission is simplified and led directly practically on the shortest path from the stroke drive to the diaphragm, such that it can also be housed in micro-pumps and can be provided in a stable and functionally reliable manner despite the tight space relationships.

Preferably, the sleeve-shaped or annular drive element is fixed at least in regions on one side of the annular diaphragm to the side facing away from the pumping chamber.

Thus the uninterrupted sealed diaphragm surface facing the working chamber is available. This is advantageous for feeding aggressive media, because there are practically no attacking points due to the smooth surface, and the side of the diaphragm facing the working chamber can be protected continuously by an uninterrupted coating, especially made from PTFE.

The sleeve-shaped or annular drive element is connected advantageously by molding with the annular diaphragm. Therefore, a lasting connection is formed. If necessary, a positive fit and/or a force fit can be used.

For the inner diaphragm fixing point, the annular diaphragm is preferably fixed by a force fit and/or held by a positive fit between a pump head part with the annular working chamber and a clamping part that can be connected to this pump head part.

In this way, the clamping part arranged for the inner diaphragm fixing point can be connected to the pump head part by a preferably central screw connection.

This central attachment of the annular diaphragm enables a simple and quick assembly and a good seal in this region. The positive-fit hold of the diaphragm, if necessary in combination with a force-fit hold, prevents undesired deflections of the diaphragm.

The clamping part for the inner diaphragm fixing point is preferably located within the annular space essentially formed by the sleeve-shaped drive element. Thus, the existing annular space is used to house the clamping part to save space.

According to a refinement of the invention, the clamping part can be connected to the annular diaphragm by molding. The annular diaphragm and the clamping part thus form one combination component in this configuration. If the sleeve-shaped drive element is also connected to the annular diaphragm by molding, then all three components form one unit, so that a simplified assembly is aided.

Through the molded-on inner clamping part, a sealed and stable connection of both components can be achieved without additional structural means.

According to one configuration of the invention, the drive element can be connected integrally with the diaphragm and can have an attachment for coupling with the pump drive.

This embodiment of the diaphragm has no separate part, which is provided as a connecting element between the actual diaphragm and the pump drive, but instead the diaphragm continues on the bottom side or on the drive side integrally with an initially sleeve-shaped part up to the eccentric drive, where there is a corresponding shape for forming an attachment for coupling with the drive. The direct connection in the region of the eccentric or a crank drive can preferably be realized through a plastic or metal part integrated (molded-on) in this region.

This embodiment of the diaphragm with integrally formed connecting element is especially simple, and sufficient compressive and tensile forces can be transferred through the sleeve-shaped, integral projection in connection with the diaphragm. The forces that can be transferred are sufficient at least for feeding gases.

For stabilization, in the drive element formed of the material of the diaphragm, reinforced points made from bending-resistant material can be integrated at least in regions.

Therefore, higher compressive and tensile forces can also be transferred. In this way, a sleeve-shaped or annular drive element formed of metal can be embedded as a reinforced point, essentially completely in the rubber-elastic diaphragm material, wherein, on the drive-side end of the sleeve-shaped or annular drive element, there is a projection made from rubber-elastic material up to the eccentric or an additional transmission element as the projection.

The annular diaphragm is also fixed by a force fit and/or held by a positive fit on its outer edge between the pump head part with the annular working chamber and a housing part that can be connected to this pump head part. Thus, a sealed and practically tension-free holder for a positive-fit holder is also present in the outer peripheral region of the annular diaphragm.

It is especially advantageous if the sleeve-shaped or annular drive element at least on the diaphragm side attaches to the annular diaphragm with its annular end facing the annular diaphragm approximately in an extension of a concentric annular surface intersecting the annular working chamber approximately in the middle. This configuration gives in a particularly good way a deformation of the diaphragm into the working chamber during the displacement stroke. This aids a practically dead space-free displacement of the feed medium.

For stabilizing the diaphragm and for a load-bearing transfer between the sleeve-shaped or annular end of the drive element and the annular diaphragm, the annular diaphragm has a preferably annular, rib-like attachment and stabilization bead, which is connected to the sleeve-shaped or annular end of the drive element, and the drive element in the connection region preferably engages in the attachment and stabilization bead or is molded-on there.

Preferably, the pump drive is embodied as an eccentric drive, which has a transmission element connected to the sleeve-shaped drive element at its end facing away from the annular diaphragm.

Additional configurations of the invention are listed in the other dependent claims.

BRIEF DESCRIPTION OF THE DRAWINGS

In the following, the invention is described in more detail with reference to the drawings.

Shown in partially schematic representation.

DETAILED DESCRIPTION OF THE PREFERRED EMBODIMENT

Figure 1:
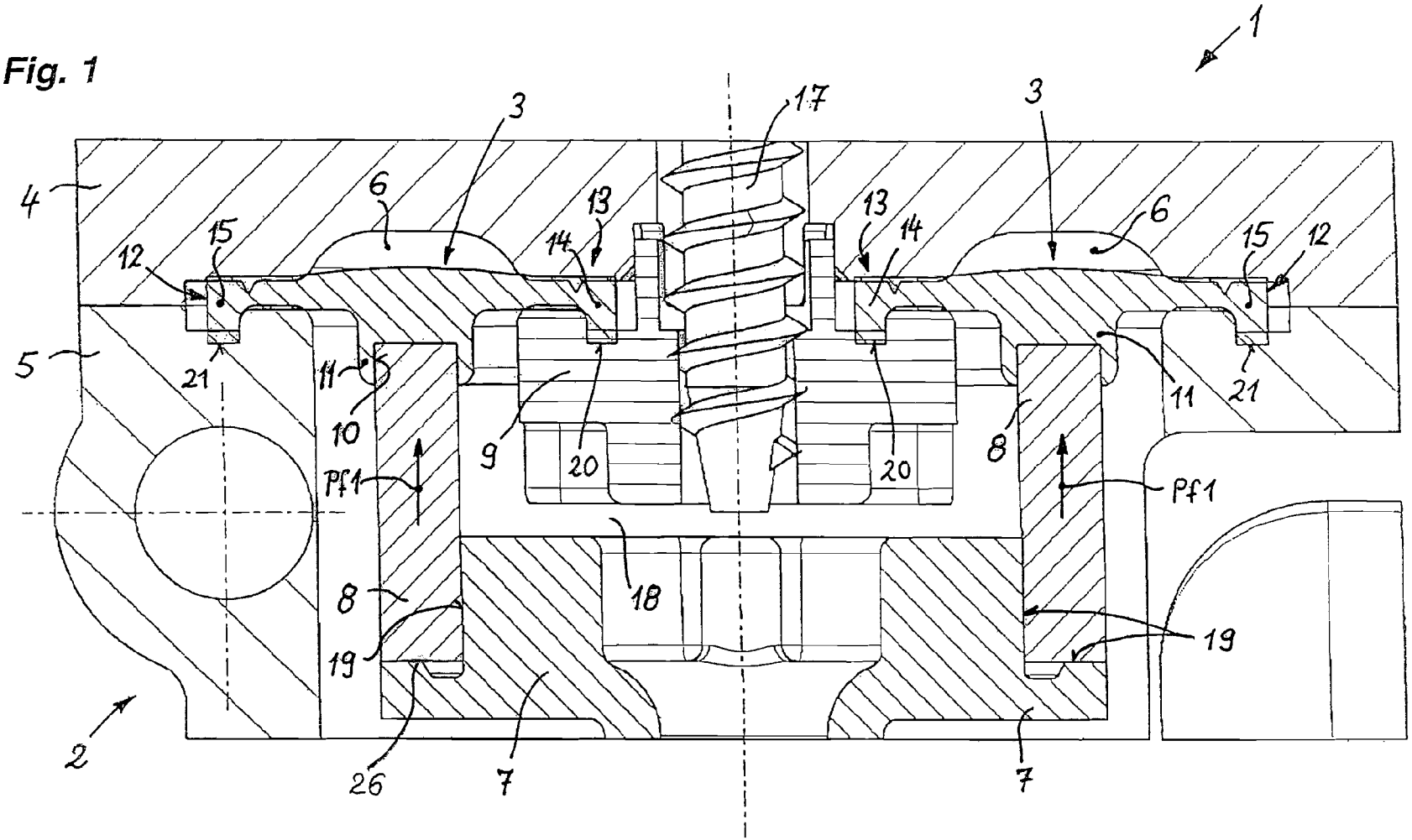
FIG. 1 is a greatly enlarged partial representation of a diaphragm pump according to the invention in cross section.

A diaphragm pump 1 shown partially in FIG. 1 has within a pump head 2 an annular diaphragm 3, which is fixed on its outer peripheral edge region between housing parts 4, 5, and also on its inner edge region between the housing part 4 and a clamping part 9. The annular diaphragm 3 defines an annular working chamber 6. For deflection of the annular diaphragm 3, a pump drive not shown here is provided, which can be embodied preferably as an eccentric drive or crank drive. It has a transmission element 7, which is connected to a sleeve-shaped drive element 8. This is connected with its other end to the annular diaphragm 3. The working chamber 6 connects via inlet and outlet channels not shown here to an inlet valve and an outlet valve. The valves are preferably formed as plate valves.

Figure 3:
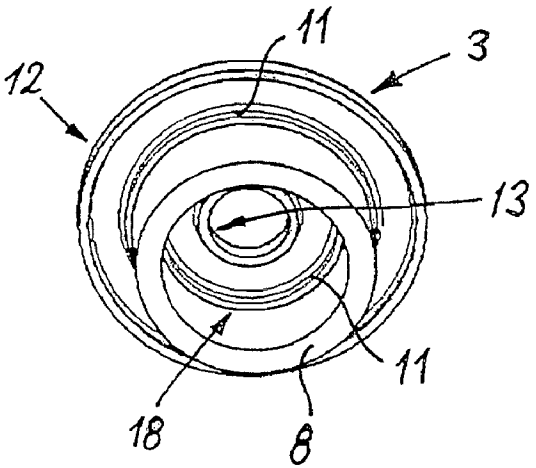
FIG. 3 is a perspective bottom view of the annular diaphragm shown in FIG. 2.
Figure 4:
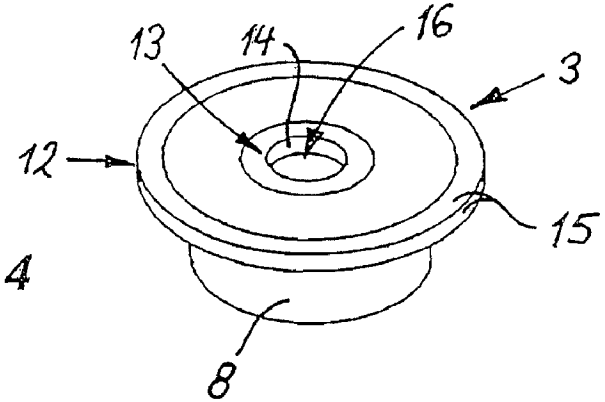
FIG. 4 is a perspective top view of the annular diaphragm shown in FIG. 2.
Figure 2:
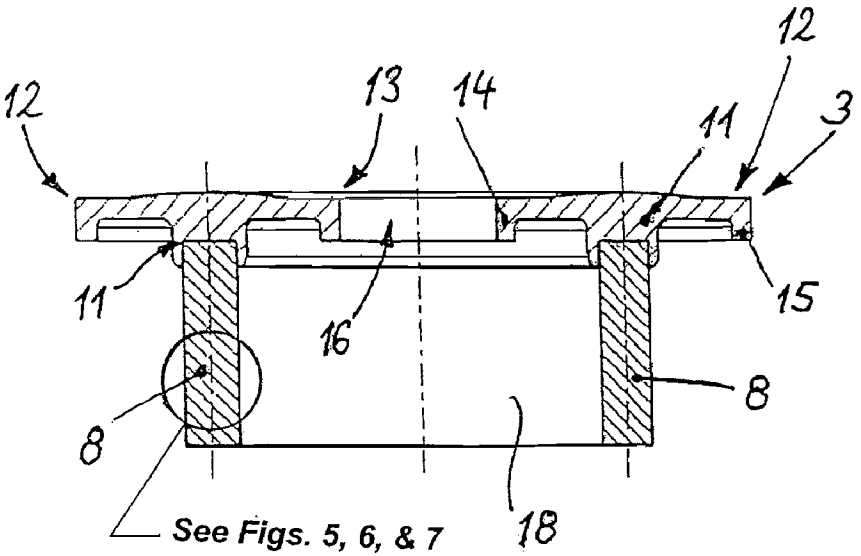
FIG. 2 is an enlarged representation of an annular diaphragm according to the invention with a connected sleeve-shaped drive element.

The annular diaphragm 3 and the connected drive element 8 are shown in FIGS. 2 to 4.

The annular diaphragm 3 is connected to one end of the sleeve-shaped drive element 8, preferably by molding. Here, the annular diaphragm 3 is formed of a rubber-elastic material, while the drive element 8 is formed, for example, by a steel sleeve. In the shown embodiment, the drive element 8 is molded into the annular diaphragm 3 and engages with one end approximately in a groove 10 at the diaphragm bottom side. Here it can be easily seen that in the connecting region between the annular diaphragm 3 and the drive element 8 there is an annular, rib-like attachment and stabilization bead 11, especially to be able to better house the element for transferring compression and tension forces from the drive element 8 into the diaphragm. The attachment and stabilization bead 11 is arranged approximately in a concentric region in the middle between the outer edge 12 and the inner edge 13 of the ring width of the annular diaphragm 3. In FIG. 1, it can also be easily seen that the annular diaphragm 3 is arranged relative to the working chamber 6 so that an approximately centered alignment of the drive element 8 or the attachment and stabilization bead 11 relative to the working chamber 6 is present.

For a stroke movement of the sleeve-shaped transmission element 8 corresponding to the arrow Pf1, the annular diaphragm is at least partially deflected in the working chamber 6, so that feed medium located therein is displaced. If necessary, the shape of the working chamber 6 and the annular diaphragm 3 can be provided so that at the top dead-center position, the diaphragm fills the working chamber with practically no dead space.

The annular diaphragm 3 is sealed relative to the housing parts 4 and 5 or also to the clamping part 9 by an inner bead 14 and by an outer bead 15. The beads 14, 15 engage in grooves 20, 21 of the housing part 5.

The housing part 4 with the annular working chamber, which forms a pump head part, has in the center relative to the central opening 16 of the annular diaphragm 3 a passage opening for an attachment screw 17 (FIG. 1), with which the clamping part 9, which is arranged on the inside of the head plate 4 and which grips below the inner diaphragm edge 13, can be fixed and can be tightened for holding the annular diaphragm 3 against the head plate 4. The clamping part 9 is located within the annular space 18 formed by the sleeve-shaped drive element 8, so that this available space is used. Overall, a pump with a smaller structural height can be realized by the direct drive transmission from an eccentric drive to the diaphragm and also by the space-saving arrangement of the clamping part 9 within the annular space 18.

The transmission element 7 connected to the drive element 8 can be a plastic part, which has a projection 19 on its end facing the drive element 8, on which the sleeve-shaped drive element 8 can be set and if necessary can be connected by a press fit or adhesive 26.

The clamping part 9 can also optionally be connected by molding to the annular diaphragm, so that a component comprised of three parts is formed together with the drive element 8. Then only a few assembly parts, which can be assembled in a short amount of time, are produced.

The diaphragm pump 1 is preferably embodied as a feed pump with a small pump capacity at a comparatively high stroke frequency. For example, with this configuration, pump capacities of 25 ml per minute can be realized, wherein 3000 strokes per minute can be provided. The high stroke count is necessary to work the valves exactly and not to have to set the tolerances of the valve parts too tightly. For such a micro-pump, the annular diaphragm 3 shown together with the drive element 8 in perspective in FIGS. 3 and 4 can have, for example, an outer diameter of 10 mm, so that the representations in FIGS. 3 and 4 would correspond approximately to a scale of 5:1.

Figure 7:
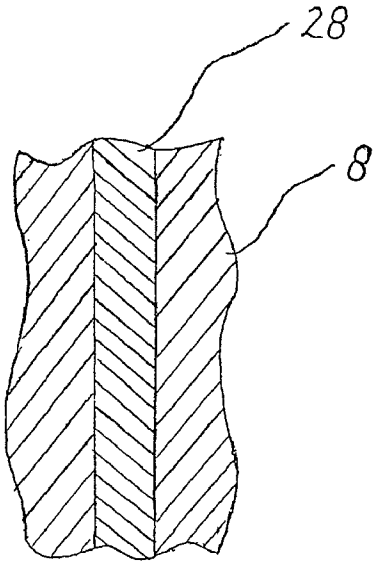
FIG. 7 is an enlarged representation of a portion of the sleeve of the drive element featuring a reinforced point.
Figure 6:
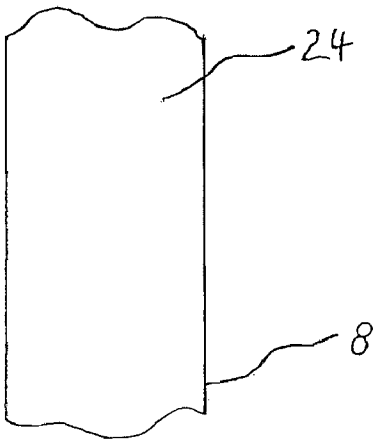
FIG. 6 is an enlarged representation of a portion of the sleeve of the drive element featuring a wall formed with a rod or a finger.
Figure 5:
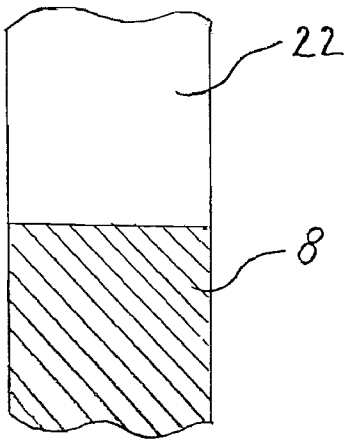
FIG. 5 is an enlarged representation of a portion of the sleeve of the drive element featuring a wall with a recess.

It should also be mentioned that the sleeve-shaped drive element 8 preferably has a continuous wall, but optionally it could also have a wall provided with recesses, such as recesses 22 or a wall formed at least in regions by rods or fingers, such as rod or finger 24, so that a corresponding mass reduction or an entrance to the inner annular space is provided. See FIGS. 5 and 6. As shown in FIG. 7, reinforced points such as indicated at 28 made from a bending-resistant material can be integrated at least into regions of the drive element 8 to further increase the stability and load carrying capacity of the drive element 8.

It should be further mentioned that the annular diaphragm 3 preferably does have a circular shape, but can also have a shape that is different from this. The same applies to the drive element 8 attached to the diaphragm or the projection of the diaphragm leading to the drive. The drive element or the projection can be embodied, at least in the attachment region at the diaphragm, preferably with the same shapes as the diaphragm and in this way, can be embodied especially like the region facing the working chamber 6 or also they can be embodied with a different shape. For example, the annular diaphragm can have an elliptical shape overall or in regions, which produces advantages in connection with a crank drive and the associated pendulum movement of the drive element. The pendulum movement preferably moves in the direction of the minor axis of the ellipse.

There is also the possibility of shaping the annular region of the diaphragm 3 defining the working chamber 6 and the outer edge region 12 differently.

With the diaphragm pump 1 according to the invention, especially a quick-running, fluid diaphragm pump is created, for which a combination of high stroke count with simultaneously low pump capacity is provided and which is nevertheless structurally simple and stable in design. Such diaphragm pumps 1 can be used primarily in laboratories or also for microsystem-specific applications. Through the diaphragm 2 according to the invention, even smaller embodiments of the diaphragm 2 than in the size shown in FIGS. 2 to 4 at a scale of about 5:1 are possible.

The invention claimed is:

1. Diaphragm pump (1) comprising an annular working chamber (6) and an annular diaphragm (3), which is fixed on an outer peripheral region (12) and on inner edge region (13) thereof, wherein inner and outer diaphragm fixing points are stationary relative to one another and a drive element (8) connected to a pump drive for deflecting the annular diaphragm (3) contacts the annular diaphragm between the outer and inner fixing points, the drive element (8) facing the diaphragm comprises a sleeve or ring shape with a diameter corresponding approximately to the annular working chamber (6) and with one annular end thereof perpendicular to a plane of and contacting a side of the annular diaphragm (3) facing the pump drive for deflection and for transmission of a back-and-forth movement to the annular diaphragm (3), wherein the drive element (8) is fixed only on one side of the annular diaphragm (3) that faces away from the working chamber (6).

2. Diaphragm pump according to claim 1, wherein the sleeve-shaped drive element (8) comprises a cylindrical sleeve with a continuous wall, a wall with recesses or a wall formed by rods or fingers at least in regions thereof.

3. Diaphragm pump according to claim 1, wherein the pump drive comprises an eccentric drive which has a transmission element (7) connected to the sleeve-shaped drive element (8) at an end facing away from the annular diaphragm (3).

4. Diaphragm pump according claim 1, wherein the annular diaphragm (3) is fixed by a force fit and/or held by positive fit at the inner diaphragm fixing points between a pump head part (4) with the annular working chamber (6) and a clamping part (9) that is connected to the pump head part.

5. Diaphragm pump according to claim 4, wherein the clamping part (9) arranged for the inner diaphragm fixing point is connected to the pump head part (4) by a central connection.

6. Diaphragm pump according to claim 4, wherein the clamping part (9) is connected to the annular diaphragm (3) by molding.

7. Diaphragm pump according to claim 4, wherein the clamping part (9) is located for the inner diaphragm fixing point within an annular space (18) formed by the drive element (8) having the sleeve shape at least in regions.

8. Diaphragm pump according to claim 1, wherein the annular diaphragm (3) is fixed by a force fit and/or held by positive fit at the outer peripheral region (12) between the pump head part with the annular working chamber (3) and a connected housing part.

9. Diaphragm pump according to claim 1, wherein the drive element (8) with the sleeve or ring shape at least on the diaphragm side connects to the annular diaphragm with an annular end facing the annular diaphragm (3) approximately in a projection of a concentric annular surface intersecting the annular working chamber (6) approximately in a middle thereof.

10. Diaphragm pump according to claim 1, wherein the annular diaphragm (3) includes an annular, rib-like attachment and stabilization bead (11), which is connected to the sleeve-shaped or annular end of the drive element (8), and the drive element attaches in a connecting region in the attachment and stabilization bead.

11. Diaphragm pump according to claim 1, wherein a side of the annular diaphragm (3) facing the working chamber (6) has a continuous coating of PTFE.

12. Diaphragm pump according to claim 1, wherein the sleeve-shaped drive element (8) is connected by at least one of molding and/or a positive fit and/or a force fit to the annular diaphragm (3).

13. Diaphragm pump according to claim 1, wherein the sleeve-shaped drive element (8) is made from metal, and the transmission element (7) that can be connected to this drive element is formed of plastic.

14. Diaphragm pump according to claim 1, wherein the annular diaphragm (3) has on the outer peripheral region (12) an outer bead (15) and on the inner edge region an inner bead (14).

15. Diaphragm pump according to claim 1, wherein the pump is a feed pump for small pump capacities in a range preferably below 100 ml per minute and a high stroke frequency of approximately 50 Hz.

16. Diaphragm pump according to claim 1, wherein the drive element (8) is connected integrally to the diaphragm (3) and has an attachment for coupling with the pump drive.

17. Diaphragm pump according to claim 16, wherein reinforced points made from bending-resistant material are integrated at least in regions in the drive element (8) consisting of the material of the diaphragm (3).

* * * * *